United States Patent [19]

Polidoro

[11] Patent Number: 4,612,435

[45] Date of Patent: Sep. 16, 1986

[54] ROLLER COUNTING DEVICE WITH ZERO RESET MECHANISM

[75] Inventor: Roberto Polidoro, Geneva, Switzerland

[73] Assignee: Sodeco-Saia AG, Murten, Switzerland

[21] Appl. No.: 692,370

[22] Filed: Jan. 17, 1985

[30] Foreign Application Priority Data

Jan. 31, 1984 [CH] Switzerland ..... 435/84

[51] Int. Cl.[4] ..... G06C 15/42

[52] U.S. Cl. ..... 235/144 DM; 235/1 D; 235/117 A; 235/144 SM; 235/144 SP

[58] Field of Search ..... 235/117 A, 1 D, 144 DM, 235/144 SM, 144 SP, 144 D, 144 TP, 144 PN

[56] References Cited

U.S. PATENT DOCUMENTS

| | | | |
|---|---|---|---|
| 3,441,210 | 4/1969 | Moore et al. | 235/144 SM X |
| 3,848,113 | 11/1974 | Kelch et al. | 235/144 M X |
| 4,314,149 | 2/1982 | Gomez | 235/144 SM X |

FOREIGN PATENT DOCUMENTS

| | | |
|---|---|---|
| 1080809 | 4/1960 | Fed. Rep. of Germany . |
| 2255980 | 5/1973 | Fed. Rep. of Germany . |
| 1673946 | 12/1975 | Fed. Rep. of Germany . |
| 3112678 | 10/1982 | Fed. Rep. of Germany . |
| 479919 | 11/1969 | Switzerland . |

*Primary Examiner*—Benjamin R. Fuller

*Attorney, Agent, or Firm*—Marmorek, Guttman & Rubenstein

[57] ABSTRACT

A simple mechanical counting device is disclosed. The counting device includes a simple zero reset mechanism which enables the counter to be easily reset to zero by the use of a finger of the human hand.

6 Claims, 7 Drawing Figures

ROLLER COUNTING DEVICE WITH ZERO RESET MECHANISM

FIELD OF INVENTION

This invention relates to a simple mechanical counting device with a zero reset mechanism.

BACKGROUND OF THE INVENTION

A typical roller counting device comprises one or more number bearing rollers rotatably mounted on a first shaft for maintaining a count. One or more notched disks are mounted on a second shaft which extends parallel to the first shaft. The notched disks engage the number bearing rollers for the purpose of advancing the count maintained by the number bearing rollers.

One drawback to prior art counting devices of this type is that they do not include a suitable mechanism for resetting the count at zero.

One such counter is disclosed in Swiss Pat. No. 479,919. In the counter described in this reference, the count is reset to zero by first disengaging the notched disks from the number bearing rollers. This is accomplished by moving the shaft on which the notched disks are mounted away from the shaft on which the number bearing rollers are mounted. Each number bearing roller is then set individually to zero by taking into consideration its individual position. No stop mechanism is provided so that the rollers automatically stop turning when the zero position is reached.

The German Patent to Soupenne DE-AS 16 73 946 discloses a number bearing roller which has a tooth protruding radially outward from its surface by a small amount. The tooth forms part of a zero reset mechanism. More particularly, during the zero reset procedure, the number bearing roller stops turning when the tooth extending outward from the number bearing roller jams against a tooth extending outward from an adjacent notched disk. However, such a stop mechanism is only useful when the distance between the shaft carrying the number bearing rollers and the shaft bearing the notched disks is precisely maintained. Such precision is difficult and consequently expensive to achieve.

The German Patent to Kübler, DE OS 31 12 678, shows a notched disk which abuts against a stop during a zero reset procedure, so that the notched disk does not rotate during the zero reset procedure. However, no zero reset mechanism suitable for use with a simple roller counting device is disclosed.

Accordingly, it is an object of the present invention to provide a simple inexpensive roller counting device that includes a zero reset mechanism which is easy to use and which overcomes the shortcomings of the prior art zero reset mechanisms.

SUMMARY OF THE INVENTION

The present invention is a simple mechanical roller counting device. The counter comprises one or more number bearing rollers which are rotatably mounted on a first shaft and one or more notched disks which are rotatably mounted on a second shaft, which extends parallel to the first shaft. When the counter is in the counting or operational configuration, a slide mechanism forces the two shafts to move close together so that teeth formed on the notched disks can engage the number bearing rollers. When the counter is in the zero reset configuration, a spring element causes the shafts to move away from each other so that the teeth of the notched disks are disengaged from the number bearing rollers. The number bearing rollers may then be rotated to the zero setting by the touch of a finger of the human hand. A trip element mounted on each of the number bearing rollers abuts against an arm extending outward from an adjacent notched disk so as to cause the number bearing roller to automatically stop rotating when the zero setting is reached. Advantageously, this stop mechanism does not depend on maintaining a precise distance between the shaft which supports the number bearing rollers and the shaft which supports the notched disks.

DETAILED DESCRIPTION OF THE INVENTION

Figure 3:
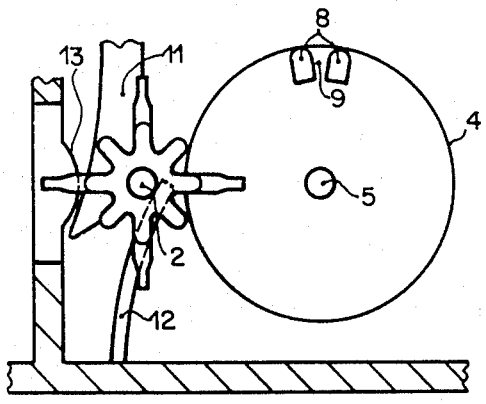
FIG. 3 illustrates a counting device in the operational or counting configuration in accordance with an illustrative embodiment of the present invention.
Figure 4:
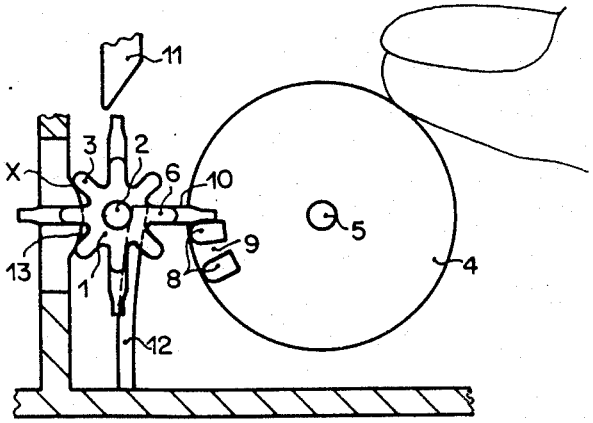
FIG. 4 illustrates the counting device of FIG. 3 in the zero reset configuration.

Turning to FIGS. 3 and 4, a counter constructed in accordance with the principles of the present invention comprises one or more number bearing rollers 4, which rollers are rotatably mounted on the shaft 5. The counter also comprises one or more notched disks 1 which are rotatably mounted on the shaft 2. When the counter is in the operational or counting configuration as shown in FIG. 3, the rollers 4 are engaged by the teeth of the disks 1. The notched disks 1 serve to cause movement of the rollers 4 so as to advance the count maintained by the counter. To reset the count at zero, the shaft 2 is transversely moved away from the shaft 5 as shown in FIG. 4. The number bearing rollers 4 may then be reset to the zero position by the touch of the human finger. An arm 10 extending outward from each of the notched disks 1 acting in concert with a trip element 8 mounted on each of the rollers 4 provides a stop mechanism which causes each of the number bearing rollers 4 to stop turning when its zero setting is reached.

Figure 1:
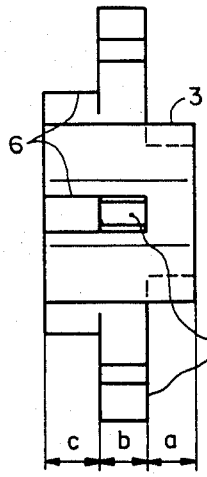
FIG. 1 is a side view of a particular embodiment of a notched disk which is incorporated into the counting device of the present invention.
Figure 2:
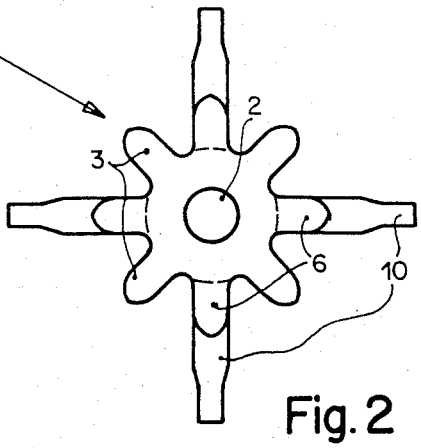
FIG. 2 is a plan view of a particular embodiment of a notched disk which is incorporated into the counting device of the present invention.

Before discussing further the operation and construction of the counter as shown in FIGS. 3 and 4, it may be useful to look first at the construction of the notched disks 1 as shown in FIGS. 1 and 2.

Extending longitudinally along each of the notched disks 1 are three zones a, b, and c. Zone a is provided with the teeth 3, which are spaced apart by equal angular spacings. When the counting device is in the operational or counting configuration, the teeth 3 engage the surface of an adjacent number bearing roller 4. As shown in FIG. 3, when the roller 4 comes to a momentary halt, the two teeth 3 which engage the roller 4, serve as stops which prevent incidental movement of the roller 4. The four teeth 3 extend through zones b and c of disk 1, as well as through zone a. Four other similarly formed teeth 6 are provided in zones b and c, of disk 1 so that a total of eight teeth extend through the zones b and c. The teeth 6 are positioned in the gaps between the teeth 3. Protruding outward from each of the four teeth 6 in the middle zone b are the arms 10.

Figure 5:
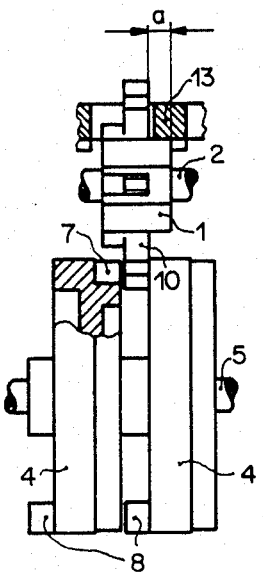
FIG. 5 illustrates the coupling between the notched disk of FIGS. 1 and 2 and the number bearing rollers which comprise the counter of FIGS. 3 and 4.

The coupling between the notched disks 1 and number bearing rollers 4 is best understood by way of reference to FIG. 5, which FIG. includes a notched disk 1 and two number bearing rollers 4. FIG. 5 shows the interaction between the notched disk 1 and the number bearing rollers 4 when the counter is in the zero reset configuration. The teeth 3 and 6 of zone c are disengaged from the groove 7 of the leftmost number bearing roller 4. Similarly, the teeth 3 of zone a are disengaged from the surface of the rightmost number bearing roller 4. One of the arms 10, protruding outward from the notched disk 1, extends into the gap between the number bearing rollers 4. To reset the rightmost number bearing roller 4 at zero, it is rotated by the touch of the human finger until the trip element 8 comes into contact with the arm 10. It should be noted that as long as one of the arms 10 is in the gap between the number bearing rollers 4, the counter is not highly sensitive to the exact distance maintained between the shafts 2 and 5. Accordingly, the counter of the present invention includes no elements for precisely maintaining this distance.

When the counter is in the operational or counting configuration, the arrangement of FIG. 5 is modified. The shaft 2 is moved inward toward the shaft 5 so that the teeth 3 and 6 of zone c of the notched disk 1 are in continual engagement with groove 7 of the leftmost number bearing roller 4. At the same time, the teeth 3 of zone a of the notched disk 1 come into contact with the surface of the rightmost number bearing roller 4. As shown in FIG. 3, the shaft 2 is pushed inward toward the shaft 5 by the slide elements 11. Each end of the shaft 2 is engaged by one of the slide elements 11. The slide elements 11 push the shaft 2 toward the shaft 5 against an opposing force provided by spring elements 12, one spring element 12 acting on each end of the shaft 2.

To change the counter from the operational configuration of FIG. 3 to the zero reset configuration of FIG. 4, the slide elements 11 are removed. The shaft 2 is then pushed outward away from the shaft 5. The outward movement of the notched disks 1 and the shaft 2 is limited by stop elements 13. There is one such stop element for each notched disk comprising the counter. To reconfigure the counter from the zero reset configuration to the operational or counting configuration, the slide elements 11 are used to propel the shaft 2 inward toward the shaft 5, thereby disengaging the notched disks 1 from the stop elements 13.

When the counter is in the zero reset configuration, two of the teeth 3 of each of the notched disks 1 abuts against one of the stop elements 13. In addition, one of the arms 10 extends into the gap between adjacent rollers 4 toward the shaft 5. Illustratively shown in FIG. 4, the number bearing roller 4 is rotated clockwise by use of a finger until one of the two trip elements 8 mounted on the surface of roller 4 meets arm 10 and movement is stopped, thereby indicating the zero setting. If roller 4 is rotated the wrong way, movement will stop when the arm 10 meets the other of the trip elements 8. In this case, the roller will be set for number nine rather than zero. Note that the gap 9 between the trip elements 8 is adapted to accommodate the zone b portion of the teeth 3.

In a preferred embodiment of the invention, it is desirable that when the arm 10 abuts against the trip element 8 as shown in FIG. 4, a force is exerted by the teeth 3 on the stop element 13. If such a force is not exerted, upon excess turning of the roller 4 (for example in the clockwise direction) the disk 1 could begin to revolve around the contact point X in FIG. 4. If this happens, the shaft 2 could be propelled to the right and become terminally jammed. The desired force results when the arms 10 and trip elements 8 are appropriately profiled. Thus, as shown in FIGS. 2 and 4, the arms 10 are slightly tapered at their ends while the trip elements 8 take on a complimentary cam-like shape.

Figure 6:
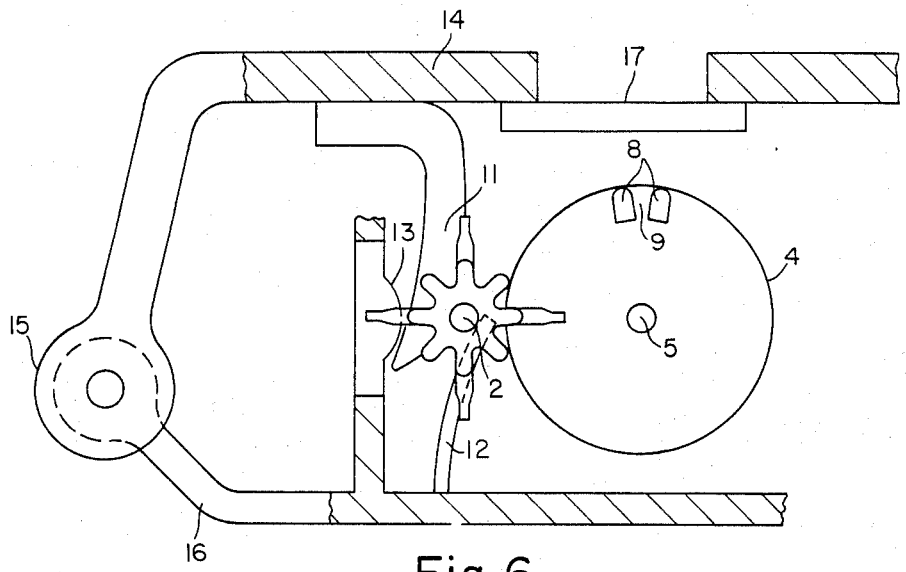
Figure 7:
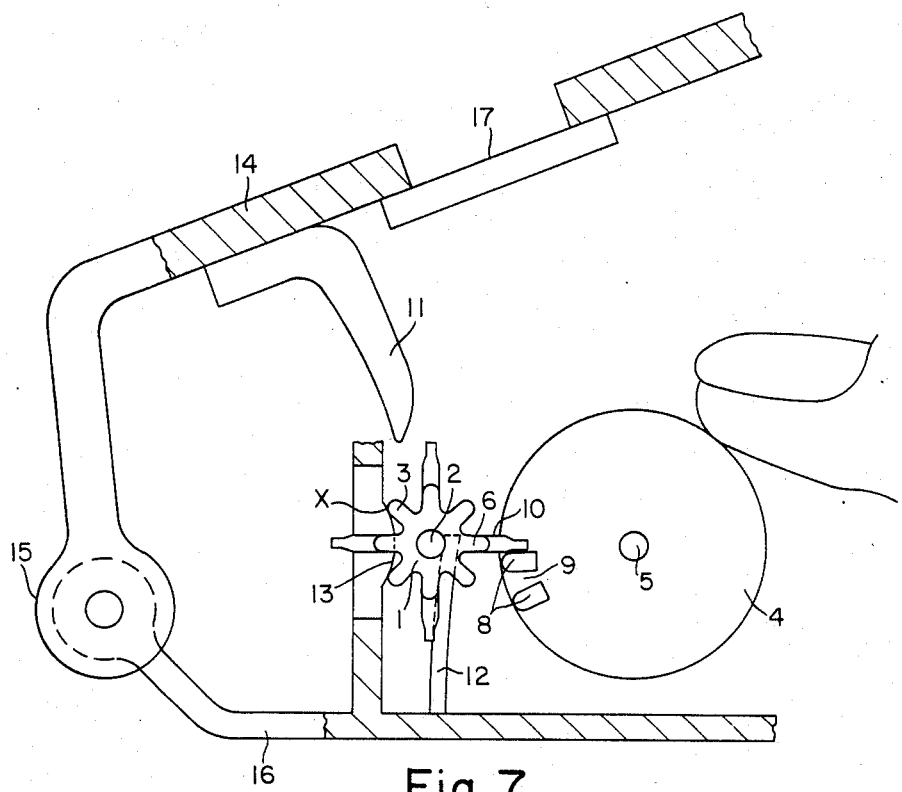

As shown in FIGS. 6 and 7, the roller counting device may be stored in a compartment comprising an upper compartment portion 14 which is mounted by way of a hinge 15 to a lower compartment portion 16. The counting mechanism itself (i.e., the notched disks and number bearing rollers, etc.) is mounted into the lower compartment portion 16. The upper compartment 14 includes an indicator window 17 for the number bearing rollers. The slide elements 11 may be incorporated as part of the upper compartment portion 14.

Thus, when the compartment is rotated open as shown in FIG. 7, the slide elements 11 are automatically disengaged from the shaft 2 and the counter is configured in zero reset configuration. To reconfigure the counter into operational or counting configuration, the compartment is rotated closed as shown in FIG. 6, thereby causing the slide elements 11 to push the shaft 2 toward the shaft 5.

Finally, the above described embodiments of the invention are intended to be illustrative only. Numerous alternative embodiments may be devised by those skilled in the art without departing from the spirit and scope of the following claims.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A roller counting device comprising (a) at least one number bearing roller for maintaining a count starting from a zero setting;

(b) a first shaft on which said number bearing roller is rotatably mounted;

(c) at least one notched disk, said notched disk having a plurality of teeth and at least one arm extending outward therefrom:

(d) a second shaft extending parallel to said first shaft on which said notched disk is rotatably mounted;

(e) trip means mounted on said number bearing roller;

(f) spring means acting on said second shaft, said spring means tending to push said second shaft away from said first shaft; and (g) slide means capable of selectively acting on said second shaft to selectively push said second shaft toward said first shaft, said counter being adapted to maintain a count when said slide means pushes said second shaft toward said first shaft against the force exerted by said spring means to cause said teeth of said notched disk to engage the surface of said number bearing roller so that said notched disk can cause said number bearing roller to move, said counter being resettable to said zero setting when said spring means operates to force said second shaft away from said first shaft so that said teeth of said notched disk are disengaged from the surface of said number bearing roller and said number bearing roller is freely rotatable until said arm extending outward from said notched disk meets said trip means mounted on said number bearing roller.

2. The counter of claim 1, wherein said counter includes a stop means for limiting the movement of said second shaft away from said first shaft.

3. The counter of claim 2, wherein one or more of said teeth of said notched disk abut against said stop means when said counter is resettable to said zero setting.

4. The counter of claim 3, wherein said arm and said trip means are profiled so that when said arm and said trip means are in contact with each other, forces are exerted by the teeth of said notched disk on said stop means.

5. The counter of claim 1, wherein said counter is stored in a compartment comprising an upper compartment portion and a lower compartment portion, said upper compartment portion being rotatably hinged to the lower compartment portion, said upper compartment portion including an indicator window for said number bearing rollers.

6. The counter of claim 5, wherein said slide means is formed as part of said upper compartment portion so that said counter is adapted to maintain said count when said compartment is closed and said counter is resettable to said zero setting when said compartment is open.

* * * * *